US008957754B2

(12) United States Patent
Schäfer et al.

(10) Patent No.: US 8,957,754 B2
(45) Date of Patent: Feb. 17, 2015

(54) WOUND TRANSFORMER CORE WITH SUPPORT STRUCTURE

(75) Inventors: Daniel Schäfer, Romrod-Zell (DE); Seung-Chul Lee, Cheonan-si (KR); Jong-Yun Lim, Chungchongnam-do (KR); Jens Tepper, Brilon (DE); Burak Esenlik, Paderborn (DE); Benjamin Weber, Winterberg (DE); Jasmin Smajic, Schöfflisdorf (CH); Bernhard Petermeier, Zürich (CH)

(73) Assignee: ABB Technology AG, Zürich (CH)

( * ) Notice: Subject to any disclaimer, the term of this patent is extended or adjusted under 35 U.S.C. 154(b) by 206 days.

(21) Appl. No.: 13/212,799

(22) Filed: Aug. 18, 2011

(65) Prior Publication Data

US 2012/0056706 A1 Mar. 8, 2012

(30) Foreign Application Priority Data

Sep. 2, 2010 (EP) ..... 10009106

(51) Int. Cl.

| | |
|---|---|
| ***H01F 27/26*** | (2006.01) |
| ***H01F 27/24*** | (2006.01) |
| *H01F 30/12* | (2006.01) |
| *H01F 41/02* | (2006.01) |

(52) U.S. Cl.

CPC ..... *H01F 27/266* (2013.01); *H01F 30/12* (2013.01); *H01F 41/0226* (2013.01)

USPC ..... 336/210; 336/213

(58) Field of Classification Search

USPC ..... 336/182, 184, 210, 211, 213, 214, 220, 336/221

See application file for complete search history.

(56) References Cited

U.S. PATENT DOCUMENTS

| | | | | | |
|---|---|---|---|---|---|
| 1,632,101 | A | * | 6/1927 | Thordarson | 336/84 R |
| 2,209,811 | A | * | 7/1940 | Dierstein | 336/212 |
| 2,372,067 | A | * | 3/1945 | Forbes | 336/210 |
| 2,946,028 | A | * | 7/1960 | Anderson et al. | 336/5 |
| 3,172,067 | A | * | 3/1965 | Gee | 336/217 |
| 3,436,707 | A | * | 4/1969 | Andersen et al. | 336/134 |
| 3,662,308 | A | * | 5/1972 | Muschong | 336/210 |
| 4,839,622 | A | * | 6/1989 | Hay | 336/92 |
| 5,069,731 | A | * | 12/1991 | Yoshizawa et al. | 148/305 |
| 5,684,446 | A | * | 11/1997 | Adkins et al. | 336/92 |
| 6,765,467 | B2 | * | 7/2004 | Ngo et al. | 336/67 |
| 6,766,572 | B2 | * | 7/2004 | Dawson et al. | 29/596 |

FOREIGN PATENT DOCUMENTS

CN 201112062 Y 9/2008

* cited by examiner

*Primary Examiner* — Mangtin Lian

(74) *Attorney, Agent, or Firm* — Buchanan Ingersoll & Rooney PC

(57) ABSTRACT

A wound transformer core is provided with at least one core loop made of a magnetic material. The transformer core includes multiple thin amorphous band-like iron sheets which are concentrically stacked around at least one center axis. A lower yoke section, an upper yoke section, and at least two limb sections are formed. The transformer core includes a modular plate-like support structure which is affixed upright to the center axis on both face sides of the lower yoke section and on both face sides of each limb section such that neighbored iron sheets are affixed together at their outer edge. The modular plate-like support structure includes, for each face side of the corresponding core sections, at least two plate-like modules, which are each connected to each other by a first or second plug-in connection.

23 Claims, 3 Drawing Sheets

WOUND TRANSFORMER CORE WITH SUPPORT STRUCTURE

RELATED APPLICATION

This application claims priority under 35 U.S.C. §119 to European Patent Application No. 09164540.8 filed in Europe on Jul. 3, 2009, the entire content of which is hereby incorporated by reference in its entirety.

FIELD

The present disclosure relates to a wound transformer core with at least one core loop made of a magnetic material. More particularly, the present disclosure relates to a wound transformer core which includes a plate-like support structure, and to a transformer including such a wound transformer core.

BACKGROUND INFORMATION

It is known that transformers with an amorphous core provide lower electrical losses than transformers with a conventional core. On the other hand, amorphous transformer cores are rather difficult to manufacture, since a suitable amorphous core material is generally only available in thin band-like sheets of a thickness of approximately a few 10 μm and a width of some 10 cm. Thus, a known amorphous core for a transformer with some few MW rated power requires some 1,000 or more layers of such concentrically stacked material. The characteristics of this material are sensitive to mechanical stress, such that a core without any stabilizing arrangement or support structure is not stable enough to bear the weight of some coils or not even its own weight.

Stabilizing arrangements are known, for example, from CN 201112062. In this publication, so-called called E-plates are suggested to be mounted and glued on both sides of major parts of the concentrically stacked transformer core. The upper yoke of the transformer core is not foreseen to be stabilized by an E-plate, since the core has to be re-opened for mounting the coils on the limbs of the transformer core.

However, on one side, the gluing process during manufacturing is rather complex. On the other side, the respective cut-off scrapes for manufacturing such an E-plate is rather high.

SUMMARY

An exemplary embodiment of the present disclosure provides a wound transformer core which includes at least one core loop made of a magnetic material. In addition, the exemplary wound transformer core includes multiple thin amorphous band-like iron sheets which are concentrically stacked around at least one center axis to form a lower yoke section, an upper yoke section, and at least two limb sections. The lower yoke section, the upper yoke section and the at least two limb sections each have a first face side and a second face on opposite sides thereof, respectively. The exemplary wound transformer core also includes a modular plate-like support structure which is affixed upright to the center axis on both the first and second face sides of the lower yoke section and on both the first and second face sides of each limb section such that neighbored iron sheets are affixed together at their outer edge. The modular plate-like support structure includes, for each face side of the lower yoke, upper yoke and limb sections, at least two plate-like modules, which are connectable to each other by one of a first plug-in connection and a second plug-in connection.

An exemplary embodiment of the present disclosure also provides a transformer which includes the wound transformer core, at least one primary electrical winding, and at least one secondary electrical winding.

BRIEF DESCRIPTION OF THE DRAWINGS

Additional refinements, advantages and features of the present disclosure are described in more detail below with reference to exemplary embodiments illustrated in the drawings, in which.

Figure 1:
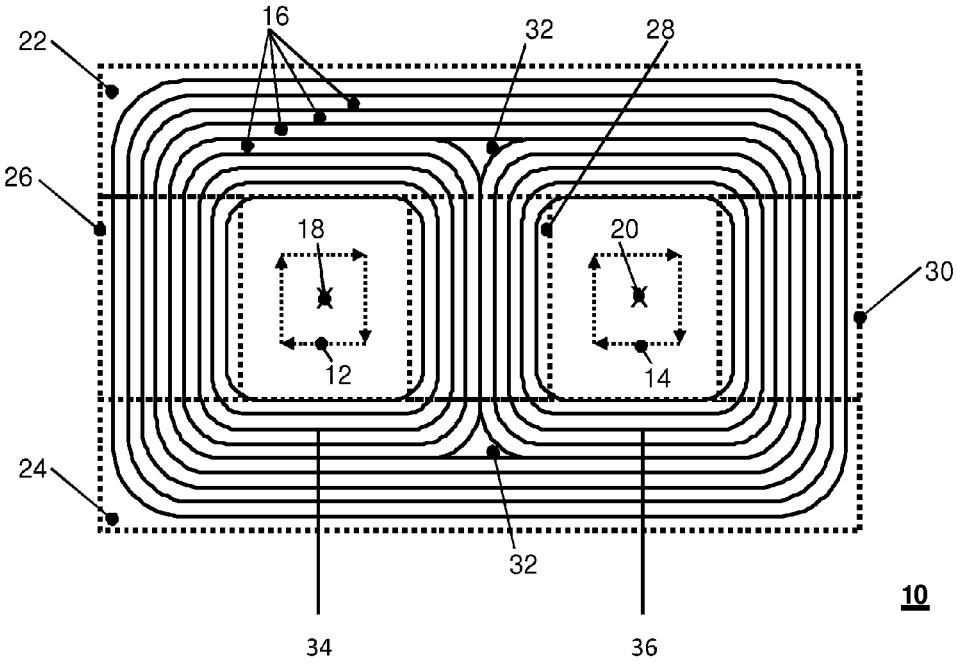
FIG. 1 shows a wound transformer core according to an exemplary embodiment of the present disclosure.

The reference symbols identified in the drawings are summarized in the list of reference symbols below.

DETAILED DESCRIPTION

Exemplary embodiments of the present disclosure provide an amorphous wound core with an improved support structure, which avoids the disadvantages of the known techniques mentioned above.

An exemplary embodiment of the present disclosure provides a wound transformer core with a modular plate-like support structure. The modular plate-like support structure includes, for each face side of the corresponding core sections, at least two plate-like modules, which are connected to each other by a first or second plug-in connection.

Accordingly, it is possible to mount a support structure in several steps by using separate modules. This arrangement simplifies the manufacturing process. The plug-in connections are shaped in such a way that one module is connectable with an adjacent module by a simple sliding or hooking movement, while the concentrically wound core is in a desirable (e.g., horizontal) position. Even the plug-in connection as such might be stiff enough to support the transformer core such that it could be useful to strengthen the connection with some amount of glue or some other connection medium, such as a screw, for example.

In accordance with an exemplary embodiment of the present disclosure, the plate-like support structure includes, for each face side of the corresponding core sections, a first plate-like module adapted to the size of the corresponding side of the lower yoke section, and further plate-like modules adapted to the size of the corresponding side of each limb section, which each are connected to the corresponding first plate-like module by a first or second plug-in connection.

In accordance with this modular arrangement, the plug-in connections have their maximum stability in vertical direction if the ready mounted transformer is in its upright (e.g., horizontal) working position. This is required for the lifting of the transformer since the transformer core itself has no own stiffness. Thus, such a transformer core can be lifted by using lifting lugs in the upper part of the upright standing transformer, whereas the major weight load is accumulated at its bottom. The upper yoke section is normally not glued together with a module of the support structure, since the transformer core has to be openable for mounting or demounting its coils. In addition, those I-shaped parts are producible without a major cut-off.

In accordance with an exemplary embodiment of the present disclosure, the plate-like support structure includes, for each face side, a second plate-like module adapted to the size of the corresponding side of the upper yoke section, which each are connected to the further plate-like modules on the corresponding sides by a first plug-in connection. To keep the upper yoke openable, it normally has not to be glued together with a module of the support structure. Furthermore, a second plate-like module—if provided—can be removable for the same purpose, thus those plug-in connections have to be openable.

According to an exemplary embodiment of the present disclosure, a first plug-in connection includes at least one barbed nozzle of at least one plate-like module which is adapted to fit into a corresponding hole in an adjacent plate-like module to be connected, so that a puzzle-piece like connection is realized. The hole might be developed as a through hole, although a milled non-through hole is also conceived. Such a connection enables an easy and robust merging together of the corresponding module parts, while the transformer core is in a horizontal manufacturing position. It only has to be ensured, that the connected parts are fixed within the same plane, for example, by gluing them on the transformer. If this kind of plug-in connection is not glued additionally with the transformer core, for example, in the case of the upper yoke, it is also easily openable.

In accordance with an exemplary embodiment of the present disclosure, at least one first or one second plate-like module includes two plates of a similar size, which are mounted together on top of each other, whereas only the plate contacting one of the face sides of the transformer core includes the respective holes into which the barbed nozzles which are fit for the connection to the adjacent modules. This is helpful to prevent a slipping of a barbed nozzle out of the corresponding hole, especially in the case of the upper yoke, where this plug-in connection has to be openable and no glue is foreseen. In addition, the second module part gets strengthened, which enables, for example, lifting lugs to be mounted thereon.

According to an exemplary embodiment of the present disclosure, a second plug-in connection includes a bent section of at least one of the plate-like modules which is hooked into a matching slit within another adjacent plate-like module to be connected. This is also a stable kind of connection, which on the other hand is not as suitable for re-opening. Thus, a second plug-in connection is conceived for the lower yoke area, since it is not required to be re-opened.

In accordance with another exemplary embodiment of the present disclosure, the plate-like support structure includes an upper U-shaped beam-like module which is adapted to the size of the upper side of the upper yoke section and which is arranged thereon, whereas those plate-like modules, which are covering both sides of the limb sections are elongated over the upper side of the upper yoke section so that the elongated parts are at least in part adjacent to the sides of the U-shaped module, such that a mechanical connection in between the adjacent parts can be achieved.

This arrangement enables a reduction of the weight of the support structure, since the U-shaped module can be built from a rather thin material. While the ready mounted transformer stands in its upright working position, no major forces are applied on the U-like module or the alternately used second plate-like modules. Only in case of a lifting of the transformer using some lifting lugs—which can be attached or part of the plate-like module related to the upper yoke—forces are applied on this module. According to this arrangement, the lifting lugs are attachable to the elongated further plate-like modules, which are adapted to the size of the sides of the limbs. Accordingly, the U-like module can be provided to fix the elongated further plate-like modules.

In accordance with an exemplary embodiment of the present disclosure, lifting lugs can be provided at both sides and both ends of the U-shaped module, whereas those lifting lugs are strengthened by congruent holes of corresponding once more elongated module parts. This enables an easy possibility to gain stable lifting lugs.

According to an exemplary embodiment, the wound transformer core can include three core loops, as well as a first, a second and a third toroidal rectangular amorphous iron sheet package. The basically round toroidal shape is developed more in a rectangular manner each including a rather rectangular shaped inner hole. The first and second iron sheet packages are arranged side by side within the inner hole of the third package. Hence, a three phase transformer core is realized, which can be implemented, for example, in distribution networks for electrical energy. Of course, other variants with more or less core loops are conceivable. For example, a five limb transformer core is realized.

In an accordance with an exemplary embodiment of the present disclosure, the corners of the toroidal rectangular developed amorphous iron packages are shaped as soft, such that two approximately triangular hollows are built inbetween the three sheet packages. At least one through bolt is arranged therethrough, which connects the opposing module parts of the support structure.

Even a connection in between the opposing modules of the support structure on both face sides of the transformer core has not to apply any pressure on the fragile core, an exemplary embodiment provides that the support structure can have a certain stiffness. This can be gained for example by the U-shaped module mentioned above, but also by through bolts with a screw thread. For example, these through bolts can be arranged near the core, whereupon the support structure is respectively enlarged to reduce the size of the coil. On the other hand, the use of the above-mentioned triangular hollow as a throughhole for through bolts enables the placing of a through bolt or such at exactly these points of the support structure, where it is most useful for stabilization purposes.

An exemplary embodiment of the present disclosure provides elongated through holes within the plate-like structure, which are arranged at least in part crosswise to the longitudinal extension of the stacked iron sheets.

An amorphous concentrically wound transformer core should not become glued with its total surface on a support structure. It is sufficient to foresee in certain distances some areas of the surface in between core and support structure with such a glue connection. Thus, exemplary embodiments of the present disclosure are based on the idea of applying the glue during the manufacturing process mainly through some elongated holes which are cut in the plate-like support structure in such a way that they are arranged at least in part crosswise to the longitudinal extension of the stacked iron sheets. Nearly all layers of the concentrically wound amorphous material are reachable at their outer edges by sections through the elongated holes. Therefore, the manufacturing process is simplified since the glue is easy to apply while the transformer core and the support structure are laid each on each other. A pre-applying of the glue is avoided or at least reduced, so that the relative position in-between the fragile core and the support structure can become optimized in an easier way before applying the glue into the elongated holes. Furthermore, a needless movement or flapping of the fragile transformer core during the gluing process is avoided. Another aspect is that the weight of the support structure is reduced by these holes.

An exemplary embodiment of the present disclosure also provides a transformer including a transformer core of the aforementioned kind and at least one primary electrical winding and at least one secondary electrical winding, as shown in FIG. 1. This transformer therefore takes advantage of the easier mounting process of such a transformer core and additionally provides lower electrical losses.

FIG. 1 shows a wound transformer core 10 according to an exemplary embodiment of the present disclosure. The wound transformer core 10 includes several layers of concentrically stacked thin amorphous band like iron sheets 16. In FIG. 1, only eight layers of the stacked sheets are 16 illustrated. However, it is to understood that the wound transformer core can include several thousand layers, depending on the size of the transformer core. A first iron sheet package is concentrically stacked around a first center axis 18, and a second iron sheet package is concentrically stacked around a second center axis 20. Each package is indicated with four layers in the example of FIG. 1. Both packages are surrounded by a common third package with an additional four indicated layers. Due to the softly shaped (e.g., rounded) corners of each package—otherwise, the iron sheets would brake in a sharply edged corner—two nearly triangular through 32 hollows are developed within the core. These hollows 32 are suitable to arrange a connection element in between the plate-like modules on both sides of the corresponding core section, for example, a screw or a bolt.

In the exemplary embodiment of FIG. 1, in total, two single core loops 12 and 14 and one common core loop over the outer limbs are developed so that this transformer core is suitable to be used for a three-phase transformer, via at least one primary electrical winding 34, and at least one secondary electrical winding 36. Due to the basically rectangular shape of the thin iron sheet packages—except for the softly shaped corners—an upper yoke section 22, a lower yoke section 24 and three limb sections 26, 28, 30 are developed. Each of these sections are illustrated within a corresponding dotted rectangle. In accordance with an exemplary embodiment, the length of one sheet of the amorphous material corresponds to the length of the entirety (e.g., 360° of the layer), whereas the cutting side can be arranged within the upper yoke section. Hence, the whole core can be opened in the upper yoke section so that a belonging coil can be positioned on the opened limbs.

Figure 2:
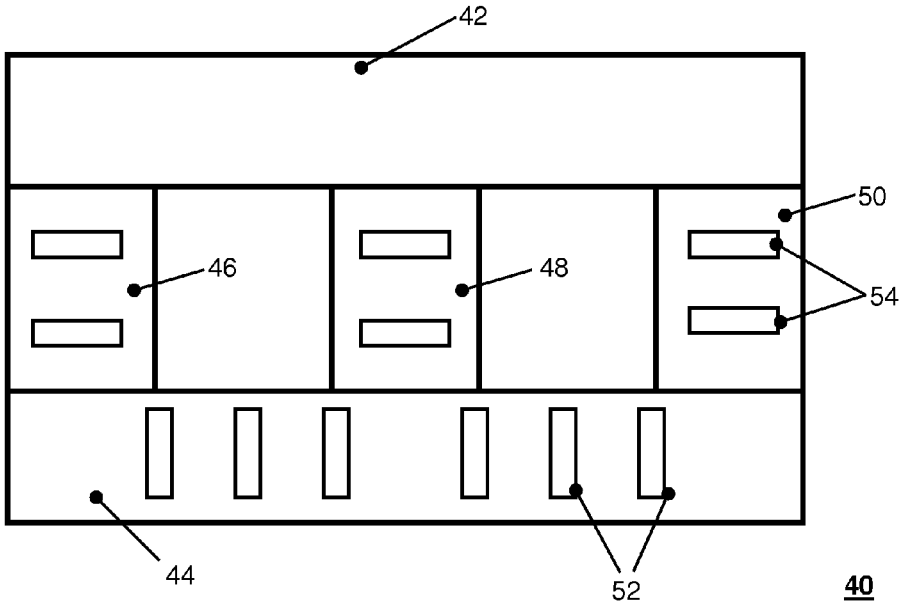
FIG. 2 shows a modular plate-like structure for one face side according to an exemplary embodiment of the present disclosure.

With reference to FIG. 2, reference symbol 40 denotes an exemplary embodiment of a modular plate-like structure which is to be mounted and affixed (e.g., glued) on one face side of such a transformer core as described above. A plate-like module adapted to each section of a transformer core of the aforementioned kind is provided, so that a first plate-like module 42 for the upper yoke section 22, a second plate like module 44 for the lower yoke section 24, and three plate-like modules 46, 48, 50 are foreseen for the limb sections 26, 28, 30, respectively. In accordance with an exemplary embodiment, the material of these modules can be a steel plate whose thickness might be in between some few millimeters up to more than one centimeter. Of course, other materials such as other metals or fiber strengthened composite materials can also be utilized. These modules and adjacent arranged plates are an example of major parts of a support structure for one side of the transformer core, whereas on the other side a symmetrical arrangement can be provided. The total size of such a support structure might amount, for example, to 0.5 m-2.5 m in two dimensions, corresponding to the size of the transformer core.

The plate-like modules 46, 48, 50 which are adapted (e.g., designed) to the size of the corresponding limb sections 26, 28, 30, and the plate-like module 44, which is adapted to the size of the lower yoke 24, are provided to be affixed (e.g., glued) on a transformer core of the aforementioned kind. To simplify the affixation (e.g., gluing) process, horizontal elongated holes 54 are cut in the limb-related modules 46, 48, 50, and vertical elongated holes 52 are cut in the lower-yoke related module 44. Thus, the elongated holes are always across to the longitudinal extension of the stacked iron sheets, so that a plate-like module can be placed in the right position on a horizontal transformer core, whereas a major part of the required glue can be applied afterward through the elongated holes 52, 54. In accordance with an exemplary embodiment, the upper yoke related module is not provided with such elongated holes, since it has to be re-openable as mentioned before and a glue connection is not useful. However, it is conceivable for the upper yoke related module 42 to be provided with such elongated holes according to various design implementations.

Figure 3:
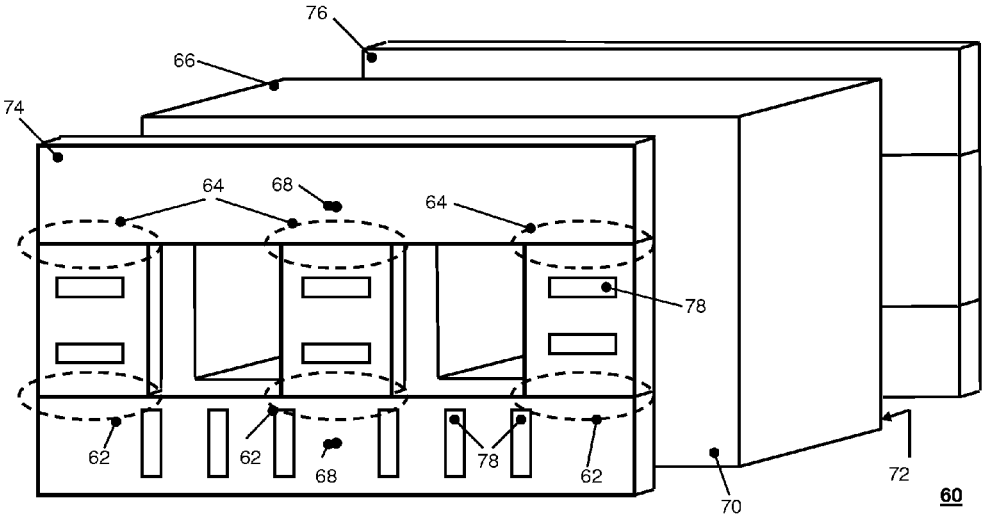
FIG. 3 shows a wound transformer core with a plate-like support structure according to an exemplary embodiment of the present disclosure.

With reference to FIG. 3, reference symbol 60 denotes a wound transformer core with a plate-like support structure according to an exemplary embodiment of the present disclosure. The plate like support structure for a transformer core 66 is divided in two major parts, one part 74 for the first face side 70 of the transformer core 66, and a symmetric part 76 for the second face side 72 of the transformer core 66. Both parts 74, 76 are illustrated in a certain axial distance to the transformer core 66, whereas in the mounted state, both parts 74, 76 are affixed (e.g., glued) thereon, except in the area of the upper yoke. A through bolt 68 indicates an axial connection in between the first part 74 and the second 76 part, whereas the connection is arranged through an approximately triangular hole of the transformer core 66. Elongated through holes 78 can provided within the modular plate-like support structure.

The symmetrical support structure parts 74, 76 mainly include two yoke-related and three limb-related plate-like module parts each, which are connected by first or second plug-in connections 62 in the lower yoke area, or only by first plug-in connections 64 in the upper yoke area. The plug-in connections 62, 64 are explained more in detail in FIG. 5 and FIG. 6 with reference symbols 100, 110, respectively. As explained thereafter, a first plug-in connection is easily re-openable, whereas a second plug-in connection is not as easy to re-open. Thus, both kinds of plug-in connections 62, 64 are suitable for the lower-yoke area, whereas plug-in connections in the upper-yoke area should be carried out as first plug-in connections 64.

Figure 4:
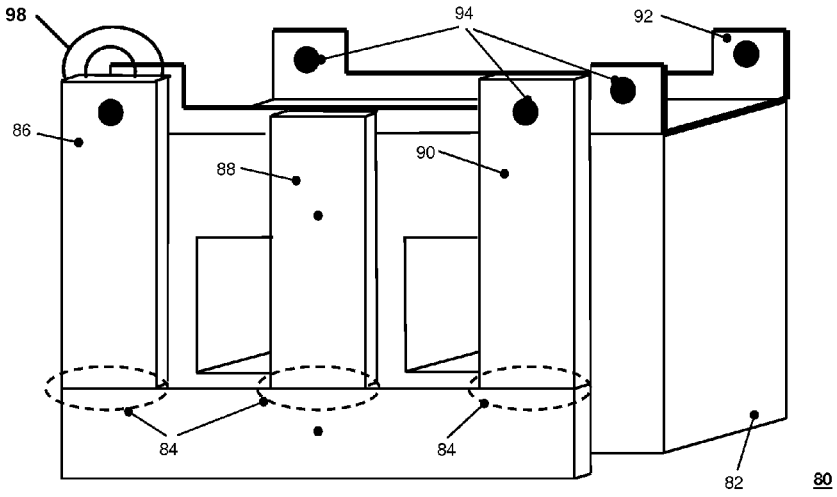
FIG. 4 shows a wound transformer core with a plate-like support structure according to an exemplary embodiment of the present disclosure.

FIG. 4 shows an exemplary embodiment of wound transformer core 82 with a plate-like support structure. It is to be noted that the part of the support structure for the second face side of the transformer core is not illustrated. In comparison to the exemplary embodiment illustrated in FIG. 4, a plate-like module for the upper yoke section is not provided. This is possible, since the ready mounted transformer is —also during transport or operation—in an upright position. Thus, no significant forces are applied on the upper yoke section, except when lifting the transformer, for example, with a crane. Hence, some contact points, for example, a load hook, may be provided in the upper yoke section. In this example, this is realized by elongated outer limb-related plate-like modules 86, 90 with some lifting lugs at their upper ends (as an example, a lifting lug 98 is illustrated on plate-like module 86). To ensure a certain stability of the hole structure, an U-shaped beam like module 92 is arranged on the upper side of the upper yoke and connected with the adjacent ends of the elongated limb-related plate like modules, for example, by screws or another re-openable connection.

Figure 5:
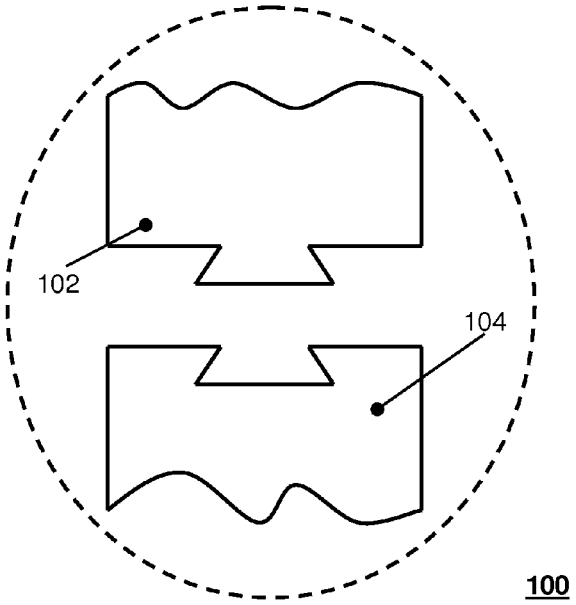
FIG. 5 shows a first plug-in connection according to an exemplary embodiment of the present disclosure.

FIG. 5 shows a first plug-in connection 100 according to an exemplary embodiment of the present disclosure. The first plug-in connection 100 includes a plate-like module 102 with a barbed nozzle adapted to fit in a hole of another plate like module 104. In accordance with an exemplary embodiment, the nozzles can be part of the limb-modules, whereas the holes are cut in a matching yoke module as contrawise. Due to the puzzle-like functionality, this kind of plug-in connection is easy to re-open.

Figure 6:
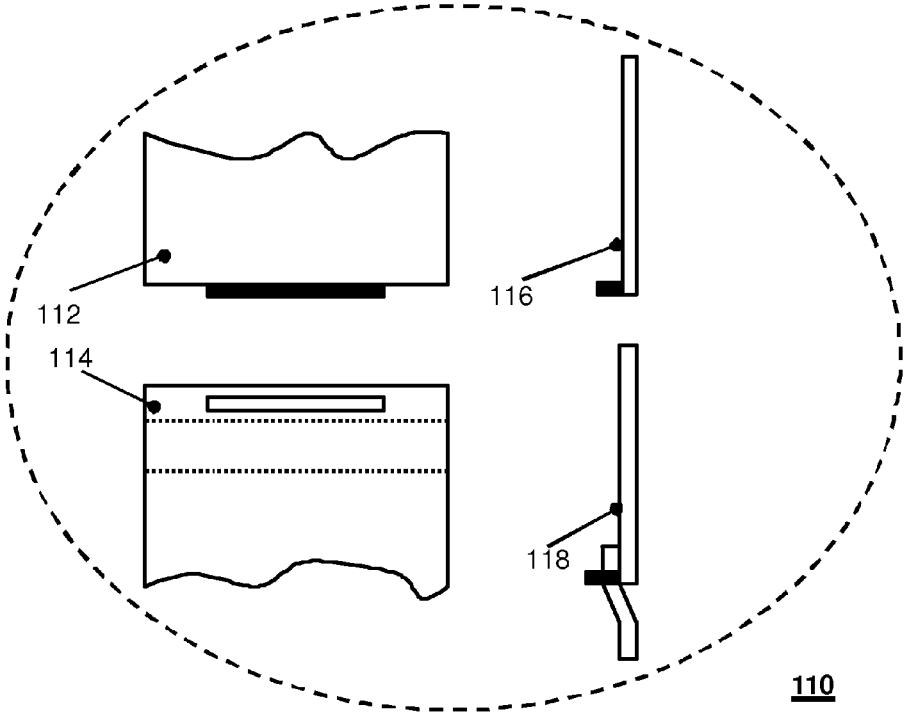
FIG. 6 shows an example for a for second plug-in connection.

FIG. 6 shows a second plug-in connection 110, which is based on a hook-functionality, according to an exemplary embodiment of the present disclosure. A plate-like module with a bent section 112 and a matching plate like module with a slit 114 is illustrated from a top perspective view. A comparable plate-like module with a bent section in a side view is denoted with reference symbol 116, whereas a side view of two connected parts is denoted with the reference symbol 118.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 wound transformer core
12 first core loop made of magnetic material
14 second core loop made of magnetic material
16 concentrically stacked thin amorphous band-like iron sheets
18 first center axis
20 second center axis
22 upper yoke section of wound transformer core
24 lower yoke section of wound transformer core
26 first limb section of wound transformer core
28 second limb section of wound transformer core
30 third limb section of wound transformer core
32 approximately triangular hollow
40 modular plate-like structure for one face side
42 plate-like module adapted to side of upper yoke section
44 plate-like module adapted to side of lower yoke section
46 plate-like module adapted to first limb section
48 plate-like module adapted to second limb section
50 plate-like module adapted to third limb section
52 vertical elongated through holes
54 horizontal elongated through holes
60 wound transformer core with a plate-like support structure
62 first or second plug-in connections
64 first plug-in connections
66 wound transformer core
68 through bolt
70 first face side of wound transformer core
72 second face side of wound transformer core
74 modular plate-like structure for first face side
76 modular plate-like structure for second face side
78 elongated through holes
80 wound transformer core with a plate-like support structure
82 wound transformer core
84 first or second plug-in connections
86 once more elongated plate-like module adapted to first limb section
88 elongated plate-like module adapted to second limb section
90 once more elongated plate-like module adapted to third limb section
92 U-shaped beam-like module
94 congruent holes of lifting lugs
100 first plug-in connection
102 plate-like module with barbed nozzle adapted to fit in hole
104 plate-like module with hole adapted to fit with barbed nozzle
110 second plug-in connection
112 plate-like module with bent section in a top view
114 plate-like module with matching slit section in a top view
116 plate-like module with bent section in a side view
118 hooked plate-like modules in a side view

What is claimed is:

1. A wound transformer core comprising:

at least one core loop made of a magnetic material;

multiple thin amorphous band-like iron sheets which are concentrically wound around at least one center axis to form a lower yoke section, an upper yoke section, and at least two limb sections, the lower yoke section, the upper yoke section and the at least two limb sections each having a first face side and a second face on opposite sides thereof, respectively; and a modular plate-like support structure which is affixed upright to the center axis on both the first and second face sides of the lower yoke section and on both the first and second face sides of each limb section such that neighbored iron sheets are affixed together at their outer edge, wherein the modular plate-like structure includes, for each face side of the lower yoke and limb sections, at least two plate-like modules glued thereon, which are connectable to each other by a plug-in connection.

2. The wound transformer core according to claim 1, wherein the plate-like support structure comprises, for each face side of the lower yoke and limb sections, a first plate-like module adapted to a size of the corresponding side of the lower yoke section, and at least one additional plate-like module adapted to a size of the corresponding side of each limb section, the at least one additional plate-like module each being connected to the corresponding first plate-like module by one of the first plug-in connection and a second plug-in connection.

3. The wound transformer core according to claim 2, wherein the plate-like support structure comprises, for each face side of the upper yoke, a second plate-like module adapted to a size of the corresponding side of the upper yoke section, each second plate-like module being connected to a corresponding one of the at least one additional plate-like module on the corresponding first and second face sides by the first plug-in connection.

4. The wound transformer core according to claim 1, wherein the first plug-in connection comprises at least one barbed nozzle of at least one plate-like module which is configured to be fit into a corresponding hole in an adjacent plate-like module to be connected to the at least one plate-like module comprising the at least one barbed nozzle.

5. The wound transformer core according to claim 4, wherein the at least two plate-like modules include at least one first plate-like module, and at least one second plate-like module, wherein at least one of the first plate-like module and the second plate-like module comprises two plates of a similar size, which are mounted together on top of each other, and wherein only the plate contacting one of the face sides of at least one of the lower yoke section, the upper yoke section and the limb sections of the transformer core comprises the hole into which the at least one barbed nozzle of the first plug-in connection is respectively fit to connect to the corresponding adjacent module, respectively.

6. The wound transformer core according to claim 1, comprising a second plug-in connection which includes a bent section of at least one of the plate-like modules, the bent section being configured to be hooked into a matching slit within another adjacent plate-like module to be connected to the at least one of the plate-like modules, respectively.

7. The wound transformer core according to claim 1, wherein the plate-like support structure comprises an upper U-shaped beam-like module which is adapted to a size of an upper side of the upper yoke section and which is arranged thereon, wherein plate-like modules covering both sides of the limb sections are elongated over the upper side of the upper yoke section such that elongated parts of the limb sections are at least in part adjacent to sides of the U-shaped module to enable a mechanical connection between adjacent parts.

8. The wound transformer core according to claim 7, comprising:

lifting lugs arranged at both sides and both ends of the U-shaped module, wherein the lifting lugs are strengthened by congruent holes of at least one corresponding more elongated module part.

9. The wound transformer core according to claim 1, comprising:

three core loops;

a first toroidal rectangular amorphous iron sheet package;

a second toroidal rectangular amorphous iron sheet package; and a third toroidal rectangular amorphous iron sheet package, wherein the first, second and third packages each have an inner hole, and the first and second iron sheet packages are arranged side by side within the inner hole of the third package.

10. The wound transformer core according to claim 9, wherein corners of the toroidal rectangular amorphous iron packages are shaped as soft, such that two approximately triangular hollows are built in between the three sheet packages, and wherein at least one through bolt is respectively arranged through the hollows to connect opposing module parts of the support structure.

11. The wound transformer core according to claim 1, comprising:

elongated through holes provided within the plate-like structure, the through holes being arranged at least in part crosswise to a longitudinal extension of the stacked iron sheets.

12. A transformer comprising:

a transformer core according to claim 1;

at least one primary electrical winding; and at least one secondary electrical winding.

13. The transformer according to claim 12, wherein the transformer is a three-phase transformer.

14. The wound transformer core according to claim 4, wherein the at least one barbed nozzle of the first plug-in connection forms a puzzle-piece like connection with the adjacent plate-like module upon being fit into the hole in the adjacent plate-like module.

15. The wound transformer core according to claim 3, wherein the first plug-in connection comprises at least one barbed nozzle of at least one plate-like module which is configured to be fit into a corresponding hole in an adjacent plate-like module to be connected to the at least one plate-like module comprising the at least one barbed nozzle.

16. The wound transformer core according to claim 15, wherein the at least two plate-like modules include at least one first plate-like module, and at least one second plate-like module, wherein at least one of the first plate-like module and the second plate-like module comprises two plates of a similar size, which are mounted together on top of each other, and wherein only the plate contacting one of the face sides of at least one of the lower yoke section, the upper yoke section and the limb sections of the transformer core comprises the hole into which the at least one barbed nozzle of the first plug-in connection is respectively fit to connect to the corresponding adjacent module, respectively.

17. The wound transformer core according to claim 3, wherein the second plug-in connection comprises a bent section of at least one of the plate-like modules, the bent section being configured to be hooked into a matching slit within another adjacent plate-like module to be connected to the at least one of the plate-like modules, respectively.

18. The wound transformer core according to claim 3, comprising:

three core loops;

a first toroidal rectangular amorphous iron sheet package;

a second toroidal rectangular amorphous iron sheet package; and a third toroidal rectangular amorphous iron sheet package, wherein the first, second and third packages each have an inner hole, and the first and second iron sheet packages are arranged side by side within the inner hole of the third package.

19. The wound transformer core according to claim 18, wherein corners of the toroidal rectangular amorphous iron packages are shaped as soft, such that two approximately triangular hollows are built in between the three sheet packages, and wherein at least one through bolt is respectively arranged through the hollows to connect opposing module parts of the support structure.

20. The wound transformer core according to claim 16, comprising:

three core loops;

a first toroidal rectangular amorphous iron sheet package;

a second toroidal rectangular amorphous iron sheet package; and a third toroidal rectangular amorphous iron sheet package, wherein the first, second and third packages each have an inner hole, and the first and second iron sheet packages are arranged side by side within the inner hole of the third package.

21. The wound transformer core according to claim 20, wherein corners of the toroidal rectangular amorphous iron packages are shaped as soft, such that two approximately triangular hollows are built in between the three sheet packages, and wherein at least one through bolt is respectively arranged through the hollows to connect opposing module parts of the support structure.

22. The wound transformer core according to claim 21, comprising:

elongated through holes provided within the plate-like structure, the through holes being arranged at least in part crosswise to a longitudinal extension of the stacked iron sheets.

23. The wound transformer core according to claim 3, comprising:

elongated through holes provided within the plate-like structure, the through holes being arranged at least in part crosswise to a longitudinal extension of the stacked iron sheets.

* * * * *